US007263320B2

(12) United States Patent
Hirayama et al.

(10) Patent No.: US 7,263,320 B2
(45) Date of Patent: Aug. 28, 2007

(54) IMAGE FORMING APPARATUS, DEVELOPING APPARATUS, AND FINELY-DIVIDED TONER PARTICLE COLLECTING APPARATUS

(75) Inventors: Junya Hirayama, Itami (JP); Shigeo Uetake, Takatsuki (JP); Masahiko Matsuura, Suita (JP); Takeshi Maeyama, Kawanishi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/305,499

(22) Filed: Dec. 15, 2005

(65) Prior Publication Data

US 2006/0133858 A1 Jun. 22, 2006

(30) Foreign Application Priority Data

Dec. 21, 2004 (JP) ..... 2004-370103

(51) Int. Cl.
*G03G 15/09* (2006.01)

(52) U.S. Cl. ..... 399/273; 399/149

(58) Field of Classification Search ..... 399/273, 399/149

See application file for complete search history.

(56) References Cited

FOREIGN PATENT DOCUMENTS

| | | | |
|---|---|---|---|
| JP | 3144673 | | 6/1991 |
| JP | 09218581 A | * | 8/1997 |
| JP | 10026885 | | 1/1998 |

* cited by examiner

*Primary Examiner*—David M. Gray
*Assistant Examiner*—Bryan Ready
(74) *Attorney, Agent, or Firm*—Brinks Hofer Gilson & Lione

(57) ABSTRACT

An image forming apparatus for forming an image by developing a latent image formed on an image carrier, using a developer including a toner and a carrier. The image forming apparatus comprises: a developer conveying member that conveys the developer; a first collecting unit that collects, by generating a first electric field, the toner from the developer at a first position that is set halfway through a route of conveyance of the developer by the developer conveying member; and a second collecting unit that collects, by generating a second electric field, residual toner from the developer at a second position that is downstream of the first position in the route of conveyance of the developer.

24 Claims, 11 Drawing Sheets

IMAGE FORMING APPARATUS, DEVELOPING APPARATUS, AND FINELY-DIVIDED TONER PARTICLE COLLECTING APPARATUS

The application is based on application No. 2004-370103 filed in Japan, the content of which is hereby incorporated by reference.

BACKGROUND OF THE INVENTION (1) Field of the Invention

The present invention relates to an image forming apparatus and a developing apparatus for developing a latent image formed on a photoreceptor drum, using a developer containing a toner and a carrier.

(2) Description of the Related Art

There are developing apparatuses, among those for use in image forming apparatuses, that adopt what is called two-component developing system. According to the developing system, a mixture of toner particles and carrier particles is stirred to generate electrical charge by the friction between them. The carrier is held on the surface of the development sleeve while the toner is attached to the carrier such that the toner is transferred via the carrier to the latent image on the photoreceptor drum so as to develop the latent image. In the two-component developing system, the development performance is influenced by the charge characteristics of the toner and the carrier to a great degree. It is accordingly required that the charge characteristics of the toner and the carrier are kept to be in good condition all through the life of the developer.

Japanese Laid-Open Patent Application No. 10-26885, for example, discloses an image forming apparatus that, if images requiring a small amount of developer are developed in succession, separates the two-component developer into the toner and the carrier to prevent the toner charge-up (excessive charge) or degradation of the carrier.

Meanwhile, in the two-component developing system, while the developer is in use, finely-divided toner particles are generated due to cuts and cracks of the toner particles that are caused by the friction between the carrier and toner.

The finely-divided toner particles are apt to attach to the surface of the carrier particles, and are gradually accumulated thereon. The more amount of finely-divided toner particles the carrier surface accumulates, the less amount of electrical charge the friction between the toner and carrier particles generates, and the less amount of electrical charge the toner has.

Japanese Laid-Open Patent Application No. 10-26885 discloses the technology for separating the toner and the carrier, but fails to consider the finely-divided toner particles. For this reason, the reduction in toner charge is observed also in the image forming apparatus of the above-mentioned Japanese patent application.

The reduction in toner charge leads to the degradation in image quality. A carrier that does not have finely-divided toner particles on the surface thereof can be obtained by changing the developer. However, frequently changing the developer increases the time and effort of the maintenance and the cost. It is therefore desirable that the developer has as long a life as possible.

SUMMARY OF THE INVENTION

The object of the present invention is therefore to provide an image forming apparatus, a developing apparatus, and a finely-divided toner particles collecting method for increasing the life of the developer by restricting the reduction in the amount of toner charge.

The above object of the present invention is fulfilled by an image forming apparatus for forming an image by developing a latent image formed on an image carrier, using a developer including a toner and a carrier, the image forming apparatus comprising: a developer conveying member that conveys the developer; a first collecting unit that collects, by generating a first electric field, the toner from the developer at a first position that is set halfway through a route of conveyance of the developer by the developer conveying member; and a second collecting unit that collects, by generating a second electric field, residual toner from the developer at a second position that is downstream of the first position in the route of conveyance of the developer.

With the above-stated construction, the first collecting unit collects from the developer the toner having the regular particle diameter, and the second collecting unit collects from the carrier surface the finely-divided toner particles that are generated due to the cuts and cracks of the toner particles and should be discarded. This keeps the toner and the carrier in good condition, where finely-divided toner particles are hardly attached to the carrier, to generate electrical charge by the friction between them. As a result of this, even as the number of printed sheets of paper increases, reduction of the amount of toner charge is restricted, and a long life of the developer is achieved.

In the above-described image forming apparatus, it is preferable that the developer includes an external additive having a polarity that is opposite of a polarity of the toner.

The inventors of the present invention devoted them selves to study to finally find that by adding to the developer an external additive having a polarity that is opposite of a polarity of the toner, the finely-divided toner particles can be collected by an electric field.

That is to say, while the developer, from which the toner having the regular particle diameter has been collected by the first collecting unit, is conveyed by the developer conveying member, the external additive having a polarity opposite of that of the finely-divided toner particles acts electrically and mechanically against the finely-divided toner particles. This makes the finely-divided toner particles easy to remove from the surface of the carrier. And the second electric field generated by the second collecting unit enables the finely-divided toner particles to be collected.

It is preferable that the above-described image forming apparatus further comprises a supply unit that supplies the developer with toner, wherein a position at which the supply unit supplies the toner is upstream of the first position in the route of conveyance of the developer.

This is because when the supply position is in the middle of the first position and the second position, the toner supplied by the supply unit is collected by the second collecting unit and the toner having the regular particle diameter is wastefully consumed, and because the supplied toner affects and makes it difficult for the second collecting unit to collect the finely-divided toner particles.

It is also preferable that the above-described image forming apparatus further comprises a toner returning unit that returns the toner collected by the first collecting unit to the developer that is being conveyed, wherein the second collecting unit stops collecting residual toner before the developer including the toner returned thereto by the toner returning unit is conveyed to the second position.

The toner collected by the first collecting unit does not include finely-divided toner particles. Therefore, by returning the collected toner into the developer and recycling the toner, it is possible to restrict the amount of consumed toner and achieve a long life of the developer. Also, if the second collecting unit does not stop collecting residual toner before the developer including the toner returned thereto by the toner returning unit is conveyed to the second position, the toner is collected by the second collecting unit and is consumed wastefully. The above-stated construction is therefore preferable.

It is preferable that the above-described image forming apparatus further comprises a discarding unit that discards the toner collected by the second collecting unit.

If the finely-divided toner particles collected by the second collecting unit are present in the developer, they attach to the carrier and make it difficult for the toner and the carrier to generate electrical charge by the friction between them. This decreases the amount of toner charge. It is therefore preferable that the unnecessary finely-divided toner particles collected by the second collecting unit are discarded.

In the above-described image forming apparatus, it is preferable that collections of toner by the first collecting unit and the second collecting unit are performed while an ordinary image forming process is not performed.

This is because the image forming process uses the toner in the developing process. Accordingly, if the toner is collected, the developing process cannot be preformed normally and normal images are not formed.

In the above-described image forming apparatus, it is preferable that the first collecting unit includes: a first rotatable member that is disposed to face the developer conveying member at a first position; and a first electric field generating unit that generates the first electric field between the developer conveying member and the first rotatable member, and the second collecting unit includes: a second rotatable member that is disposed to face the developer conveying member at a second position; and a second electric field generating unit that generates the second electric field between the developer conveying member and the second rotatable member.

The above-stated construction enables the first and second collecting units to be manufactured by a simple construction. This reduces the cost for the apparatus.

In the above-described image forming apparatus, it is preferable that the image carrier is used as the second rotatable member.

With the above-stated construction, the image carrier, which is generally used in the image forming apparatus, is used as the second rotatable member. This reduces the number of components constituting the apparatus, resulting in the reduction in space of the apparatus and cost.

In the above-described image forming apparatus, it is preferable that the first electric field is substantially equal to the second electric field in size.

With the above-stated construction, the toner having the regular particle diameter that was not collected by the first electric field is not collected by the second electric field, either. That is to say, the toner having the regular particle diameter and the finely-divided toner particles are not collected by the second collecting unit in mixture. This means that the consumption of the toner having the regular particle diameter is restricted.

The above object of the present invention is also fulfilled by a developing apparatus for developing a latent image formed on an image carrier, using a developer including a toner and a carrier, the developing apparatus comprising: a developer conveying member that conveys the developer; a first collecting unit that collects, by generating a first electric field, the toner from the developer at a first position that is set halfway through a route of conveyance of the developer by the developer conveying member; and a second collecting unit that collects, by generating a second electric field, residual toner from the developer at a second position that is downstream of the first position in the route of conveyance of the developer.

With the above-stated construction, the first collecting unit collects the toner from the developer, and the second collecting unit collects the finely-divided toner particles that should be discarded. This keeps the toner and the carrier in good condition, where finely-divided toner particles are hardly attached to the carrier, to generate electrical charge by the friction between them. As a result of this, even as the number of printed sheets of paper increases, reduction of the amount of toner charge is restricted, and a long life of the developer is achieved.

The above object of the present invention is also fulfilled by a developing apparatus for developing a latent image formed on an image carrier, using a developer including a toner and a carrier, the developing apparatus comprising: a developer conveying member that conveys the developer; and a first collecting unit that collects, by generating a first electric field, the toner from the developer at a first position that is set halfway through a route of conveyance of the developer by the developer conveying member, wherein the image carrier is disposed to face the developer conveying member at a second position that is downstream of the first position in the route of conveyance of the developer, and at the second position, a second electric field is generated to move residual toner from the developer after the toner is collected therefrom by the first collecting unit, to the image carrier.

With the above-stated construction, the first collecting unit collects the toner from the developer, and the finely-divided toner particles that should be discarded are collected by the image carrier. This keeps the toner and the carrier in good condition, where finely-divided toner particles are hardly attached to the carrier, to generate electrical charge by the friction between them. As a result of this, even as the number of printed sheets of paper increases, reduction of the amount of toner charge is restricted, and a long life of the developer is achieved.

In the above-described image forming apparatus, it is preferable that the developer includes an external additive having a polarity that is opposite of a polarity of the toner.

While the developer, from which the toner has been collected by the first electric field, is conveyed by the developer conveying member, the external additive having a polarity opposite of that of the finely-divided toner particles acts electrically and mechanically against the finely-divided toner particles. This makes the finely-divided toner particles easy to remove from the surface of the carrier. And the second electric field urges the finely-divided toner particles to be collected.

It is preferable that the above-described image forming apparatus further comprises a toner returning unit that returns the toner collected by the first collecting unit to the developer that is being conveyed, wherein the second collecting unit stops collecting residual toner before the developer including the toner returned thereto by the toner returning unit is conveyed to the second position.

The toner collected by the first collecting unit does not include finely-divided toner particles. Therefore, by returning the collected toner into the developer and recycling the toner, it is possible to restrict the amount of consumed toner and achieve a long life of the developer. Also, if the second collecting unit does not stop collecting residual toner before the developer including the toner returned thereto by the toner returning unit is conveyed to the second position, the toner is collected by the second collecting unit and is consumed wastefully. The above-stated construction is therefore preferable.

It is preferable that the above-described developing apparatus further comprises a toner returning unit that returns the toner collected by the first collecting unit to the developer that is being conveyed, wherein the second electric field is stopped before the developer including the toner returned thereto by the toner returning unit is conveyed to the second position.

The toner collected by the first collecting unit does not include finely-divided toner particles. Therefore, by returning the collected toner into the developer and recycling the toner, it is possible to restrict the amount of consumed toner and achieve a long life of the developer. Also, if the second electric field does not stop collecting residual toner before the developer including the toner returned thereto by the toner returning unit is conveyed to the second position, the toner is collected by the image carrier and is consumed wastefully. The above-stated construction is therefore preferable.

It is preferable that the above-described developing apparatus further comprises a supply unit that supplies the developer with toner, wherein a position at which the supply unit supplies the toner is upstream of the first position in the route of conveyance of the developer.

This is because when the supply position is in the middle of the first position and the second position, the toner supplied by the supply unit is collected by the second collecting unit and the toner having the regular particle diameter is wastefully consumed, and because the supplied toner affects and makes it difficult for the second collecting unit to collect the finely-divided toner particles.

In the above-described developing apparatus, it is preferable that the first electric field is substantially equal to the second electric field in size.

With the above-stated construction, the toner having the regular particle diameter that was not collected by the first electric field is not collected by the second electric field, either. That is to say, the toner having the regular particle diameter and the finely-divided toner particles, which should be discarded, are not collected in mixture. This means that the consumption of the toner having the regular particle diameter is restricted.

The above object of the present invention is also fulfilled by a finely-divided toner particles collecting method for collecting finely-divided toner particles that are generated by cuts and cracks of toner particles, in an image forming apparatus for forming an image by developing a latent image formed on an image carrier, using a developer including a toner and a carrier, the finely-divided toner particles collecting method comprising: a first collecting step of collecting the toner from the developer by a first electric field; and a second collecting step of collecting the finely-divided toner particles from the developer by a second electric field, after the toner is collected therefrom in the first collecting step.

With the above-stated construction, the first collecting step collects the toner having the regular particle diameter from the developer, and the second collecting step collects the finely-divided toner particles that should be discarded. This keeps the toner and the carrier in good condition, where finely-divided toner particles are hardly attached to the carrier, to generate electrical charge by the friction between them. As a result of this, even as the number of printed sheets of paper increases, reduction of the amount of toner charge is restricted, and a long life of the developer is achieved.

In the above-described finely-divided toner particles collecting method, it is preferable that in the first collecting step, the toner is collected into a first collecting member, and in the second collecting step, the finely-divided toner particles are collected into a second collecting member that is different from the first collecting member.

With the above-stated construction, the toner having the regular particle diameter is collected into the first collecting member from the developer, and the finely-divided toner particles that should be discarded are collected into the second collecting member. That is to say, the toner having the regular particle diameter and the finely-divided toner particles are not collected in mixture. This means that the consumption of the toner having the regular particle diameter is restricted by recycling the toner having the regular particle diameter collected into the first collecting member.

In the above-described finely-divided toner particles collecting method, it is preferable that the developer includes an external additive having a polarity that is opposite of a polarity of the toner.

This is because the external additive having a polarity opposite of that of the finely-divided toner particles acts electrically against the finely-divided toner particles. This makes the finely-divided toner particles easy to remove from the surface of the carrier. And the second collecting step urges the finely-divided toner particles to be collected.

In the above-described finely-divided toner particles collecting method, it is preferable that the first electric field is substantially equal to the second electric field in size.

With the above-stated construction, the toner having the regular particle diameter that was not collected by the first electric field is not collected by the second electric field, either. That is to say, the toner having the regular particle diameter and the finely-divided toner particles are not collected by the second collecting unit in mixture. This means that the consumption of the toner having the regular particle diameter is restricted.

In the above-described finely-divided toner particles collecting method, it is preferable that collections of toner in the first collecting step and the second collecting step are performed while an ordinary image forming process is not performed.

This is because the image forming process uses the toner in the developing process. Accordingly, if the toner is collected, the developing process cannot be preformed normally and normal images are not formed.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

The following describes an example in which an embodiment of a developing apparatus and an image forming apparatus of the present invention is applied to a monochrome digital copier (hereinafter merely referred to as a "copier")

<Construction>

Figure 1:
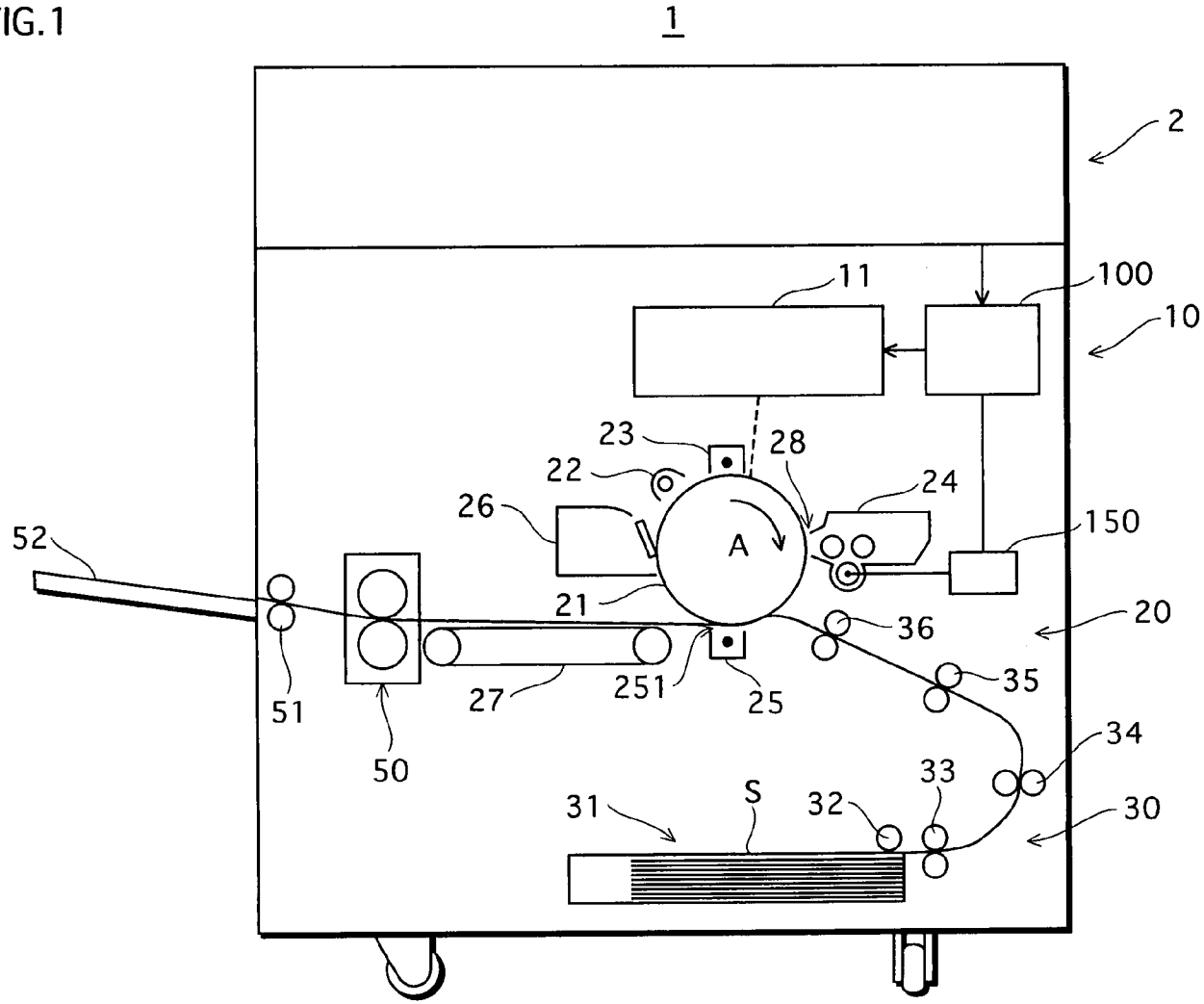
FIG. 1 shows the overall construction of a copier 1.

First, the-overall construction of the copier will be described with reference to FIG. 1. FIG. 1 shows the overall construction of a copier 1.

As shown in FIG. 1, the copier 1 is roughly divided into an image reader unit 2 and a printer unit 10.

The image reader unit 2, based on a known technology, reads an image from a document using a CCD sensor (not illustrated) to obtain an electric signal, and sends the obtained electric signal to a control unit 100. The control unit 100 generates image data by subjecting the received electric signal to a necessary process, and converts the image data into a drive signal that is used to drive a laser diode (not illustrated) of a printer head 11.

The printer unit 10 includes the printer head 11, an image processing unit 20, a paper feeding unit 30, and a fixing unit 50.

The printer head 11 drives the laser diode to emit a laser beam for performing exposure scan of the surface of a photoreceptor drum 21, based on the drive signal output from the control unit 100.

The image processing unit 20 includes the photoreceptor drum 21 that rotates in the direction of arrow A. The image processing unit 20 also includes an electricity removing lamp 22, an electrical charger 23, a developing apparatus 24, a transfer charger 25, a cleaner 26 and the like that are disposed around the photoreceptor drum 21.

The paper feeding unit 30 includes a paper feed cassette 31 for storing paper S, a pickup roller 32 for picking up the paper S out of the paper feed cassette 31 and feeding it forward, conveyance roller pairs 33-35 for conveying the paper S fed forward by the pickup roller 32, and a timing roller pair 36 for adjusting the timing of feeding the paper S to the photoreceptor drum 21 to the timing of the exposure scan.

Before the photoreceptor drum 21 is exposed to the laser beam emitted from the printer head 11, the cleaner 26 removes residual toner from the surface of the photoreceptor drum 21, the electricity removing lamp 22 removes residual electric charge from the surface, and the electrical charger 23 electrically charges the surface evenly (in this example, for the surface to have minus charge). When the photoreceptor drum 21 is exposed to the laser beam while it has the electrical charge as mentioned above, a latent image is formed on the surface of the photoreceptor drum 21.

The latent image is developed by the developing apparatus 24 at a developing position Z to form a toner image on the surface of the photoreceptor drum 21. It is supposed in this example that the toner has the same polarity (negative polarity) as the photoreceptor drum 21, and as a result of this, what is called the reverse development is conducted. In synchronization with this toner image formation operation, the paper S is conveyed by the timing roller pair 36 to a transfer position 251 under the photoreceptor drum 21.

The toner image formed on the surface of the photoreceptor drum 21 is transferred onto the paper S by the corona discharge caused by the transfer charger 25 at the transfer position 251. The paper S with the transferred toner image is separated from the photoreceptor drum 21 and conveyed by a conveyance belt to the fixing unit 50. The fixing unit 50 applies heat and pressure to the paper S so that the toner particles on the paper S fuse and are bonded with, that is, fixed to, the paper S. After the fusion bonding, the paper S is ejected by an outlet roller pair 51 into an outlet tray 52.

A power supply unit 150, in accordance with an instruction from the control unit 100, applies a bias voltage to a buffer roller in the developing apparatus 24. The bias voltage will be described later in detail.

Figure 2:
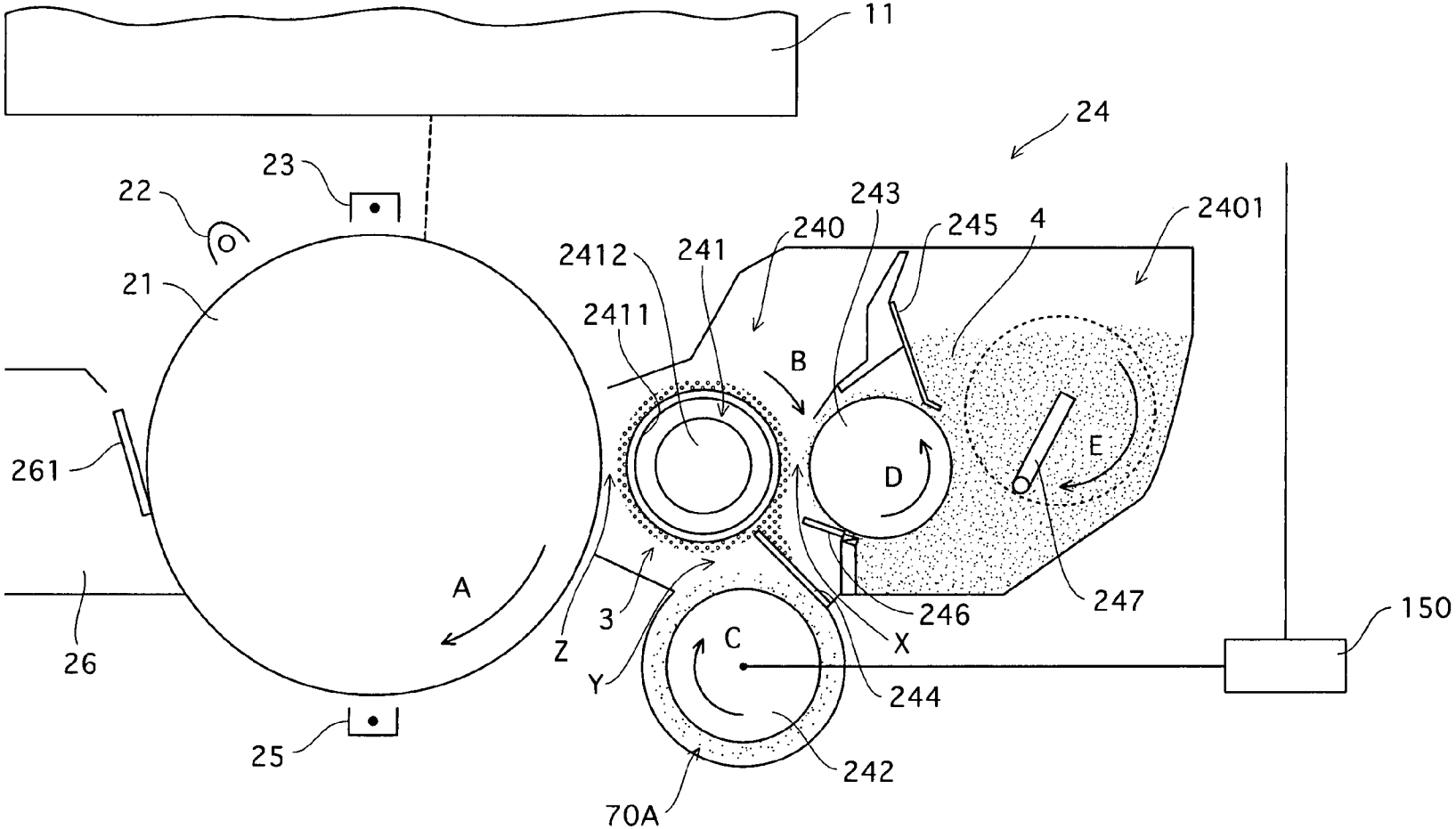
FIG. 2 is an enlarged view showing the construction of the photoreceptor drum 21 and the developing apparatus 24.

The following describes the construction of the developing apparatus 24 with reference to FIG. 2. FIG. 2 is an enlarged view showing the construction of the photoreceptor drum 21 and the developing apparatus 24.

As shown in FIG. 2, the developing apparatus 24, for performing the developing using a developer 3 that contains a carrier and a toner, includes a developer containing unit 240 and a toner containing unit 2401. It should be noted here that FIG. 2 is drawn for the purpose of explaining the construction of the developing apparatus 24, not accurately reflecting the actual measurement and ratios.

The developer containing unit 240, for containing the developer, includes a developing roller 241, a buffer roller 242, and a developer restricting plate 244.

The developing roller 241 includes: a metal cylindrical member 2411 that is driven to rotate in the direction of arrow B; and a magnet roller 2412 that is loosely inserted in the cylindrical member 2411 so as not to rotate. The developing roller 241 conveys the developer 3 to the developing position Z while the developer 3 is adsorbed on the surface of the cylindrical member 2411 by the magnetic force of the magnet roller 2412. In this sense, it may be said that the developing roller 241 functions as a developer conveyance member. At the developing position Z, the toner particles in the developer 3 move to portions of the surface of the photoreceptor drum 21 that were exposed to the laser beam. This causes a toner image to be formed on the photoreceptor drum 21 (that is to say, the latent image is developed).

The developer restricting plate 244 is positioned a predetermined distance (in this example, 0.4 mm) away from the developing roller 241 to restrict the amount of the developer that passes the gap between itself and the developing roller 241 such that an even, thin layer of the developer 3 is formed on the surface of the developing roller 241. The carrier and toner in the developer 3 are charged with electricity of an amount that is required for the developing, up to which the electricity increases by the friction charge that occurs when the developer 3 is conveyed on the developing roller 241 and restricted by the developer restricting plate 244.

The buffer roller 242 is a cylindrical roller made of aluminum that is driven to rotate in the direction of arrow C. The buffer roller 242 is positioned to face the developing roller 241 at a position that is between the photoreceptor drum 21 and the developer restricting plate 244. That is to say, the developing roller 241 and the buffer roller 242 face each other at a facing position Y, and the photoreceptor drum 21 and the developing roller 241 face each other at a facing position Z, where the facing position Z is downstream of the facing position Y in the path in which the developer is conveyed by the developing roller 241.

In the present embodiment, it is supposed that the distance between the developing roller 241 and the buffer roller 242 at the facing position Y is substantially equivalent to the distance between the developing roller 241 and the photoreceptor drum 21 at the facing position Z.

The potential on the surface of the buffer roller 242 changes depending on the power supply from the power supply unit 150. The buffer roller 242 does not operate in the ordinary print processes, but functions as a collecting member that collects the toner from the developer 3 in the finely-divided toner particles collection process which will be described later.

The toner containing unit 2401 contains toner 4 to supply. The toner containing unit 2401 includes a toner supply roller 243, a toner restriction plate 245, a toner electricity removing member 246, and a toner stirring rod 247. The toner 4 is the same as the toner (having the negative polarity) contained in the developer 3.

The toner stirring rod 247 is driven to rotate in the direction of arrow E to stir the toner 4 in the toner containing unit 2401 to prevent the toner from hardening and to maintain its fluidity.

The toner restriction plate 245 forms an even, thin layer of the toner 4 by restricting the amount of toner attached to the surface of the toner supply roller 243, and also electrically charges the toner 4 in reserve. In this example, a thin plate made of a metal, for example, stainless, (thickness: approximately 80 μm), and the tip is pressed onto the surface of the toner supply roller 243 with the line pressure of 5-40 [N/m]. It should be noted here that the material, line pressure or the like of the toner restriction plate 245 are not limited to the above-described ones in so far as it can, to a large degree, reduce the pressure unevenness of the toner supply roller 243 in the longitudinal direction and can form the thin layer without giving excessive stress to the toner particles.

The toner supply roller 243 is positioned to face the developing roller 241 with a predetermined distance (in this example, 0.8 mm) in between, and is driven to rotate in the direction of arrow D to convey the toner 4, causing it to pass the toner restriction plate 245, to a supply position X at which the toner 4 faces the developing roller 241 such that the developer containing unit 240 (developer 3) is supplied with the conveyed toner 4 as the supply toner.

The supply position X is up stream of the facing position Y in the path in which the developer is conveyed. This is because if the supply position X is in the middle of the facing position Y and the developing position Z, the conveyed toner is collected by the photoreceptor drum 21 in the finely-divided toner particles collection process which will be described later, and the toner particles having the regular particle diameter are wastefully consumed.

The toner supply roller 243 is achieved by a roller which is made of a metal such as aluminum and has the outer diameter of 18 mm and whose surface is given a certain level of roughness by the blast process to improve the conveyability. It is needless to say that the toner supply roller 243 is not limited to the above-described roller, but may be a conductive roller member or a conductive roller member whose surface is coated with a semiconductor film.

The toner electricity removing member 246 is provided to remove the residual toner 4 from the surface of the toner supply roller 243, the residual toner 4 being the toner that has remained there without being supplied to the developer containing unit 240 at the supply position X. And before the residual toner 4 is returned to inside the toner containing unit 2401, the static-electrical attachment force applied to the toner supply roller 243 is reduced so that the residual toner 4 can be easily removed from the surface of the toner supply roller 243. In this example, the toner electricity removing member 246 is made from a film-like member made of synthetic resin to which the conductivity has been attached. It should be noted here that not limited to the above-described material, the toner electricity removing member 246 may be made of any material that reduces the amount of electrical charge of the toner 4 when contacting therewith, due to their relationship in the triboelectric series.

The developer 3 contains a carrier and a toner. The carrier includes ferrite particles that are 40 μm in particle diameter and are covered with silicon-based resin.

The toner used here is styrene acrylic polymerization toner to which hydrophobic silica and strontium titanate have been added as external additives. The hydrophobic silica is charged with minus electricity. The strontium titanate is charged with plus electricity after it is subjected to the surface treatment with amino-based silane.

The developer 3 is obtained by, for example, mixing the carrier and the toner such that the toner is 8% by weight.

Figure 3:
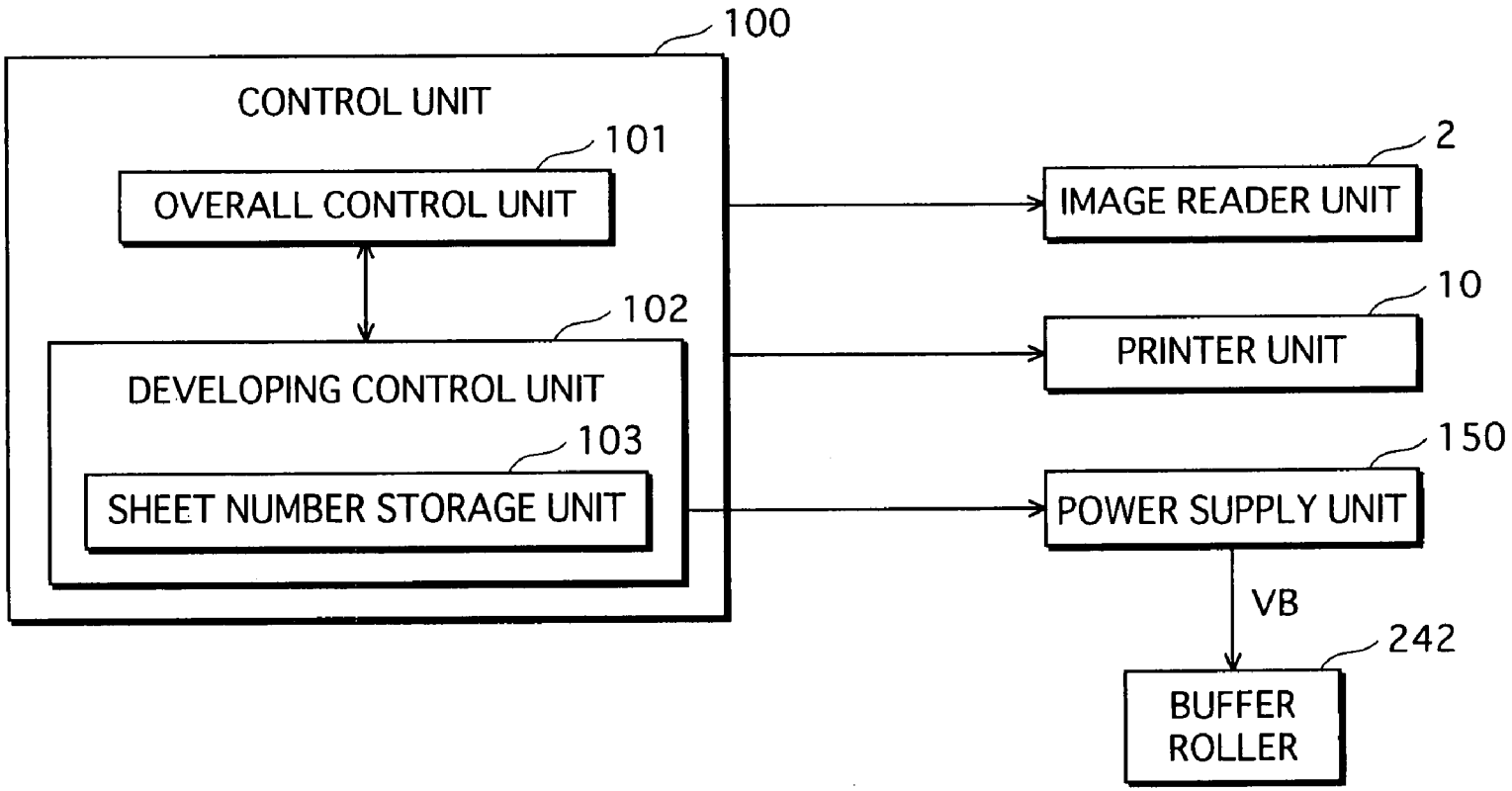
FIG. 3 is a block diagram showing the construction of the control unit 100.

FIG. 3 is a block diagram showing the construction of the control unit 100.

As shown in FIG. 3, the control unit 100 includes an overall control unit 101 and a developing control unit 102. The overall control unit 101 and the developing control unit 102 include the CPU, ROM, RAM and the like as the main components.

The overall control unit 101 controls the operation of the image reader unit 2 and the printer unit 10 as a whole so that the copying operation is executed smoothly.

The developing control unit 102 includes a sheet number storage unit 103 for counting the number of printed sheets and accumulates the results of the counts. The developing control unit 102 controls the bias voltage output from the power supply unit 150.

<Finely-divided Toner Particles Collection Process>

The toner in the developer is subjected to many machinery actions caused in the developing apparatus. For example, the toner is stirred by the toner stirring rod 247, and is frictioned with the carrier. These actions bring about many cuts and cracks on the toner particles, which generate finely-divided toner particles that are smaller than the regular toner particles in particle diameter.

As explained in "Description of the Related Art", a conventional problem is that the finely-divided toner particles, which are apt to attach to the surface of the carrier particles, are gradually accumulated thereon, and the more amount of finely-divided toner particles the carrier surface accumulates, the less amount of electrical charge the friction between the toner and carrier particles generates, and the less amount of electrical charge the toner has.

The more the amount of finely-divided toner particles is, the more the force of them to attach to the carrier surface is, and eventually they form a layer that is attached to the carrier surface with a strong force. Once the finely-divided toner particles form such a layer, it is difficult to remove the layer from the carrier. It is therefore required to collect the finely-divided toner particles from the surface of the carrier before they are accumulated on the surface of the carrier particles. This taken into consideration, the present embodiment has the finely-divided toner particles collection process that is performed before the finely-divided toner particles form such a layer so that the finely-divided toner particles can be collected from the surface of the carrier.

Figure 4:
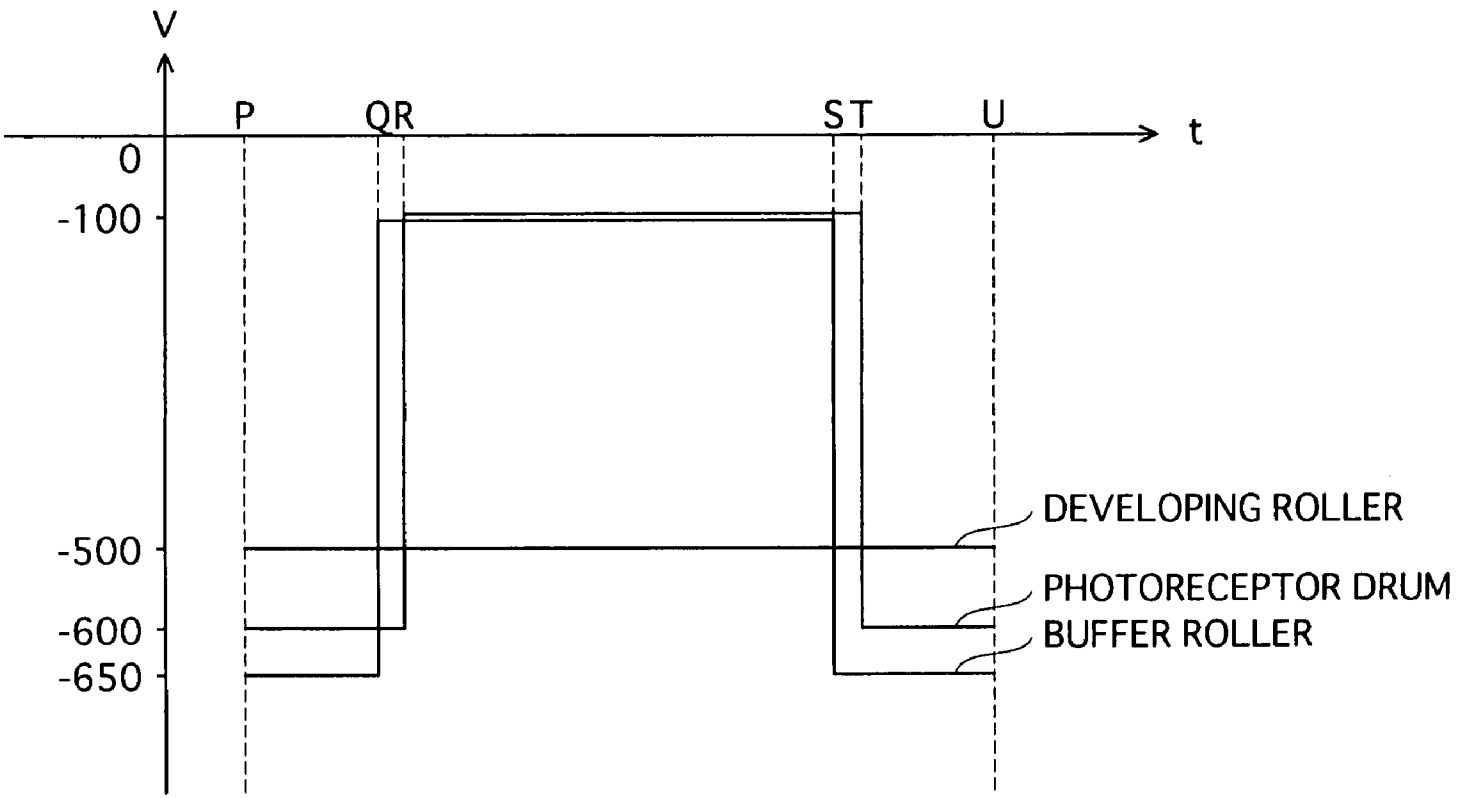
FIG. 4 shows changes with time in potentials of the developing roller 241, the buffer roller 242, and the photoreceptor drum 21 in the finely-divided toner particles collection process.

The following describes the finely-divided toner particles collection process with reference to FIGS. 2 to 8. FIG. 4 shows changes with time in potentials of the developing roller 241, the buffer roller 242, and the photoreceptor drum 21 in the finely-divided toner particles collection process.

Figure 5:
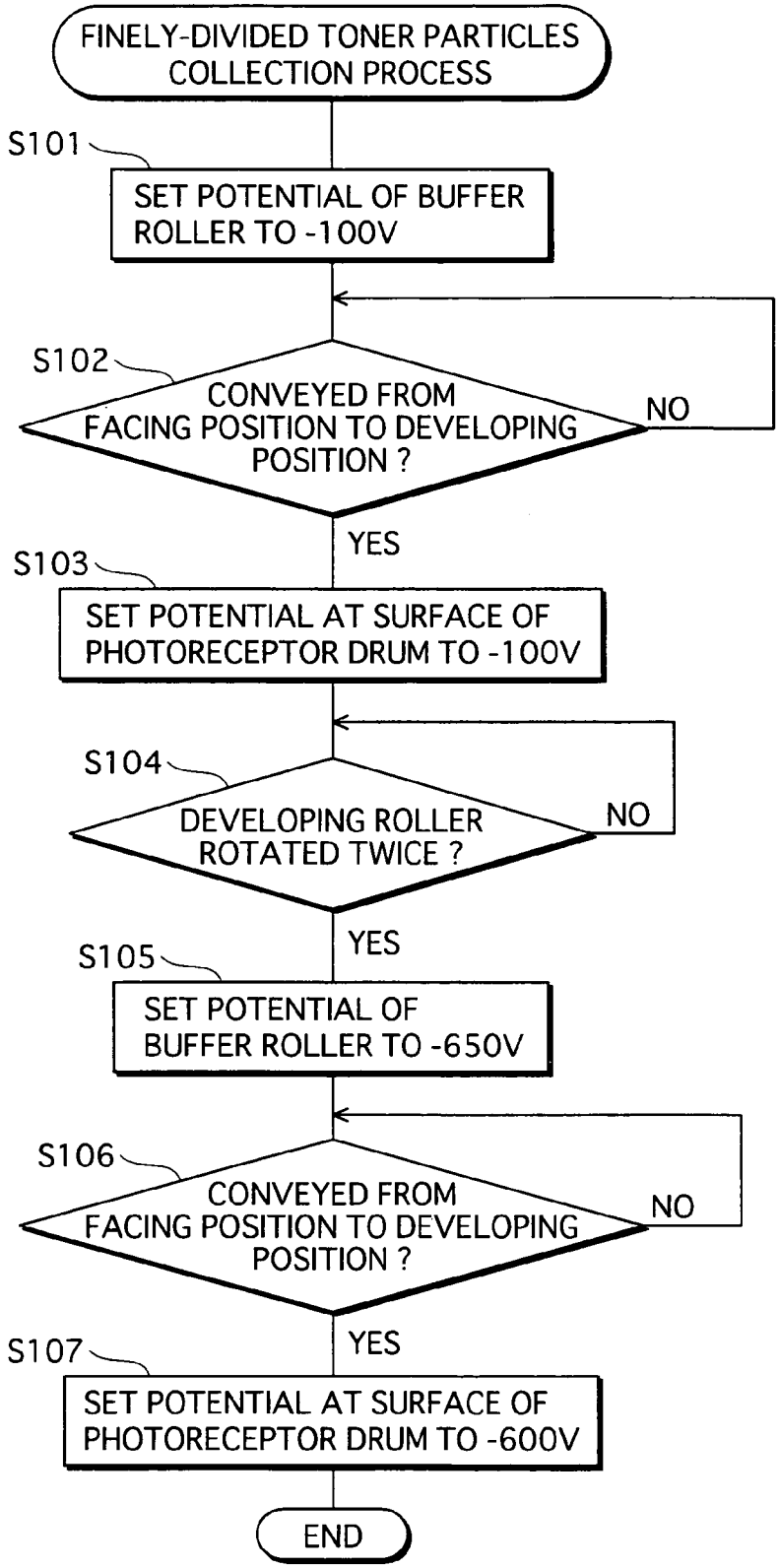
FIG. 5 is a flowchart showing the control performed by the developing control unit 102 in the finely-divided toner particles collection process.

The vertical axis of the graph represents the potential, and the horizontal axis represents the time. FIG. 5 is a flowchart showing the control performed by the developing control unit 102 in the finely-divided toner particles collection process.

As shown in FIG. 4, when the print process ends (at time P in FIG. 4), the potentials of the components are as follows: the developing roller 241 . . . −500V; the buffer roller 242 . . . −650V; and the photoreceptor drum 21 . . . −600V.

The potential of the developing roller 241 is constantly −500V during the print process and the finely-divided toner particles collection process which are performed in succession.

Figure 6:
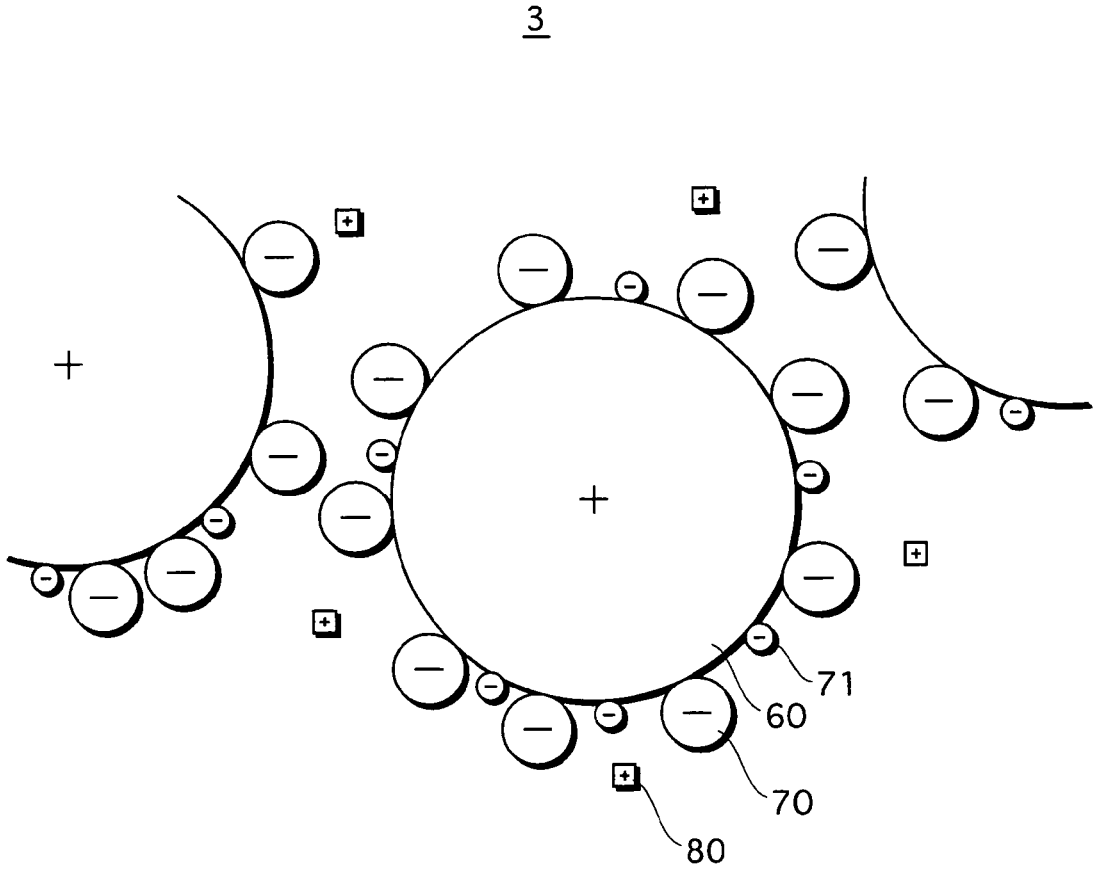
FIG. 6 is an enlarged view of the developer.
Figure 7:
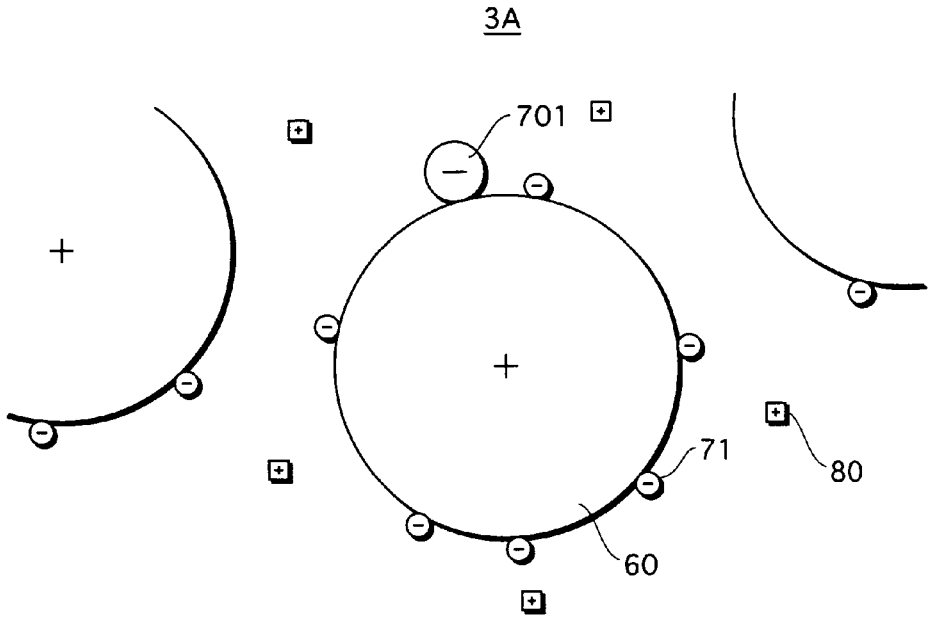
FIG. 7 is an enlarged view of the developer.
Figure 8:
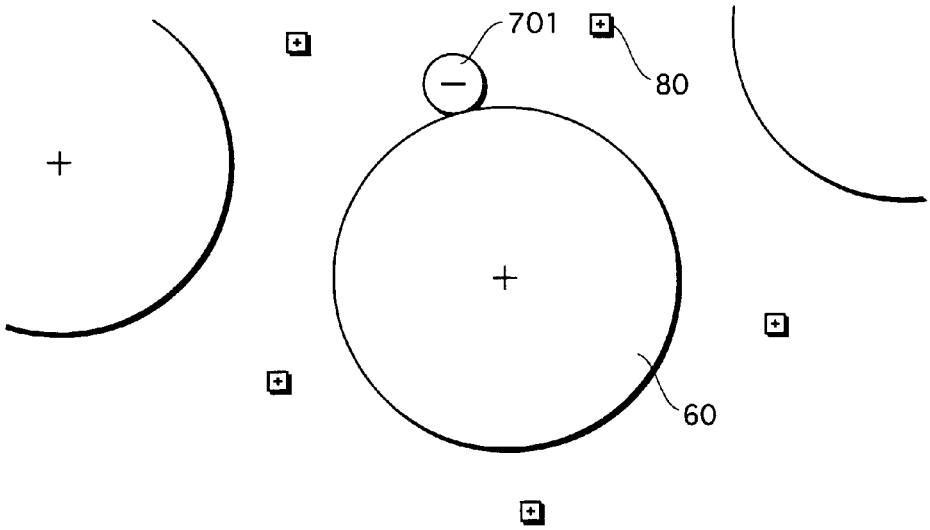
FIG. 8 is an enlarged view of the developer.

FIGS. 6 to 8 are enlarged views of the developer. FIG. 6 shows the state of the developer 3 at time P, that is, immediately after the print process is completed. As shown in FIG. 6, the toner 70 and finely-divided toner particles 71 both having the minus charge are attached to the surface of the carrier 60 that has the plus charge. The hydrophobic silica (not illustrated) having been added as an external additive to the toner 70 is attached to the surface of the toner, but the strontium titanate 80 having the plus charge has been removed from the toner 70 due to the machinery actions given during the conveyance of the developer.

At time Q shown in FIG. 4 when the finely-divided toner particles collection process starts, the developing control unit 102 controls the power supply unit 150 such that the buffer roller 242 applies a plus-side bias to the developing roller 241. More specifically, the potential of the buffer roller 242 is set to −100V when the potential of the developing roller 241 is −500V (step S101).

With this operation, an electric field is generated at position Y shown in FIG. 2 where the two rollers face each other, due to the potential difference between the buffer roller 242 and the developing roller 241. As the electric field is generated, the toner 70 with the regular particle diameter having the minus charge moves to the buffer roller 242 having a higher potential than the toner. This causes the toner 70 to be collected from the developer 3 (developer 3A) as shown in FIG. 7. During this process, the finely-divided toner particles 71 are hardly affected by the electric field since they are blocked by the toner 70 that has larger particle diameter than them.

Accordingly, the finely-divided toner particles 71 remain on the surface of the carrier 60. The buffer roller 242 therefore collects the toner 70 having the regular particle diameter, without collecting the finely-divided toner particles 71.

Due to the difference between toner particles in the degree at which they are affected by the electric field, there may be some particles among those of the toner 70 that are not moved by an electric field of a predetermined strength. For this reason, a small amount of residual toner 701 with the regular particle diameter remains on the surface of the carrier 60.

The developer 3A shown in FIG. 7 from which the toner 70 has been collected at the facing position Y is conveyed by the developing roller 241 in the B direction. It is considered that during the conveyance, the strontium titanate 80 moves freely in the developer 3A as it receives various actions like shaking. In this way, the developer 3A, from which the toner 70 was collected, is conveyed to the developing position Z where the developing roller 241 and the photoreceptor drum 21 face each other (step S102: Yes). In doing this, the developing control unit 102 performs a control so that the potential at the surface of the photoreceptor drum 21 becomes higher than the potential of the developing roller 241 (at time R). More specifically, the developing control unit 102 discharges the surface of the photoreceptor drum 21 by the laser diode of the printer head 11 so that the potential at the surface of the photoreceptor drum 21 is −100V at the developing position Z at time R (step S103). The potential is equivalent to the potential at which the latent image is developed in the ordinary print process.

With this operation, due to the difference between the developing roller 241 and the photoreceptor drum 21 in potential, an electric field is generated at the developing position Z, and due to the electric field, the finely-divided toner particles 71 with the minus charge having been attached to the carrier 60 are collected by the photoreceptor drum 21 having a higher potential than them. As a result of this, as shown in FIG. 8, the finely-divided toner particles 71 hardly exist on the surface of the carrier 60.

The reason why the finely-divided toner particles 71 are collected by the photoreceptor drum 21 by the generation of the electric field is considered as follows. That is to say, while the developer 3A, from which the toner 70 was collected by the buffer roller 242 (see FIG. 7), is conveyed from the facing position Y to the developing position Z by the developing roller 241, the strontium titanate 80 (an external additive) having a polarity opposite of that of the finely-divided toner particles 71 acts, electrically and mechanically, against the finely-divided toner particles 71 that have the minus charge. This makes the finely-divided toner particles 71 easy to remove from the surface of the carrier 60.

The finely-divided toner particles 71 collected by the photoreceptor drum 21 are removed from the surface of the photoreceptor drum 21 by a cleaner blade 261 of a cleaner 26.

It should be noted here that since the electric fields generated at the facing position Y and the developing position Z are approximately the same in size, the residual toner 701 having the regular particle diameter size, which did not move to the buffer roller 242 by the electric field at the facing position Y, does not move to the photoreceptor drum 21 by the electric filed at the developing position Z, either. That is to say, the residual toner 701 having the regular particle diameter size and the finely-divided toner particles 71 are not collected by the photoreceptor drum 21 in mixture. This means that the consumption of the toner having the regular particle diameter size is restricted.

Incidentally, at the developing position Z, an alternating voltage, as well as a direct voltage, is superimposed on the photoreceptor drum 21 in the ordinary print process. The residual toner 701 is affected by an electric field that is generated by the voltages, and becomes easy to move to the photoreceptor drum 21. Accordingly, the residual toner 701 contributes to the developing of the latent image, as well.

It should be noted here that the time lag between time Q and time R shown in FIG. 4 is equivalent to the time required for the developer 3A, which passed the facing position Y at time Q, to reach the developing position Z.

During the time period from time Q in FIG. 4 until the developing roller 241 rotates twice, a bias voltage is applied to the buffer roller 242, and the whole surface of the photoreceptor drum 21 is exposed. As the developer 3 (see FIG. 6) is conveyed during this time period by the developing roller 241, the toner 70 is collected at the facing position Y (see FIG. 7), and the finely-divided toner particles 71 are collected at the developing position Z (see FIG. 8). In this way, the finely-divided toner particles 71 in the developer 3 are gradually collected.

At time S when the developing roller 241 has rotated twice after time Q shown in FIG. 4 (step S104: Yes), the developing control unit 102 returns the potential of the buffer roller 242 to −650V by controlling the power supply unit 150 (step S105) During this time period, an electric field is generated due to the potential difference between the developing roller 241 and the buffer roller 242, and the generation of the electric field causes the toner on the buffer roller 242 to return to the developing roller 241 of the higher potential. The toner 70A (see FIG. 2) collected by the buffer roller 242 does not contain the finely-divided toner particles. Therefore, by returning the toner 70A collected by the buffer roller 242 into the developer 3 and recycling the toner, it is possible to restrict the amount of consumed toner and achieve a long life of the developer 3.

The developer 3A from which the toner was collected at the facing position Y at time S is conveyed to the developing position Z where the developing roller 241 and the photoreceptor drum 21 face each other (time T) (step S106: Yes). It should be noted here that the time lag between time S and time T is equivalent to the time required for the developer 3, from which the toner was collected at time S at the facing position Y, to be conveyed by the developing roller 241 to the developing position Z.

The developing control unit 102, at time T, adjusts the exposure by the laser diode of the printer head 11 so that the potential on the surface of the photoreceptor drum 21 at the developing position Z becomes −600V (step S107). When this is done, the collection of the toner by the photoreceptor drum 21 is stopped until the developer 3 including the toner, which was returned from the buffer roller 242, is conveyed to the developing position Z. This is because without this stopping, the toner having the regular particle diameter would be collected by the photoreceptor drum 21 to be wastefully consumed.

It should be noted here that the time period between time S and time T is equivalent to a time period that is enough for all the toner collected by the buffer roller 242 to be returned to the developer 3 at the facing position Y.

It should be noted here that during the time period between time Q and time U shown in FIG. 4, the supply of the developer 3 by the toner supply roller 243 is stopped at the supply position X. Since the toner collected by the buffer roller 242 is returned to the developer 3, the amount of the toner that is decreased in the finely-divided toner particles collection process is equivalent to the amount of the finely-divided toner particles that are collected by the photoreceptor drum 21. The amount of the finely-divided toner particles is very small compared with the amount of the whole toner in the developer. Therefore, if the toner is supplied by the toner supply roller 243 during the time period between time Q and time U in the finely-divided toner particles collection process, the ratio of the toner in the developer 3 becomes excessive.

With the above-described finely-divided toner particles collection process, the finely-divided toner particles 71 are collected from the developer 3 to the photoreceptor drum 21, and discarded. This makes it possible to cause friction appropriately between particles of the carrier 60 and the toner 70 to generate electrical charge, and achieve a long life of the developer 3.

The above-described finely-divided toner particles collection process is performed while the ordinary print process (image forming process) is not performed. For example, the finely-divided toner particles collection process is performed during (i) a time period from the power-on of the copier 1 to a printing operation, (ii) a time period between printing operations, and (iii) a wait time. Furthermore, from the viewpoint of achieving a long life of the developer, it is preferable that the process is performed per a predetermined number of sheets of paper that are printed with images. For example, the finely-divided toner particles collection process with the sequence shown in FIG. 4 may be performed twice every time two sheets of paper are printed, and maybe performed 5 times every time 50 sheets of paper are printed. The number of printed sheets is accumulated by the sheet number storage unit 103 of the developing control unit 102, and if the accumulated number reaches a predetermined number, the finely-divided toner particles collection process is performed under the control of the developing control unit 102.

Also, in the construction for performing the finely-divided toner particles collection process, the present embodiment uses the photoreceptor drum 21, which is ordinarily provided in a copier, as a member for collecting the finely-divided toner particles. Such use of the photoreceptor drum 21 contributes to the reduction in the number of components constituting the apparatus, thus contributing to the reduction in space of the apparatus and cost.

EXAMPLE

The following describes advantageous effects of the copier 1 in the present embodiment, based on an example.

The inventors of the present invention performed characteristic tests on the copier 1 in the present embodiment and a copier having the conventional construction. More specifically, for the invention example, the copier 1 in the present embodiment was used, and the finely-divided toner particles collection process was performed twice performed twice every time a sheet of paper was printed, and was performed 10 times every time 100 sheets of paper were printed, until 120 k sheets of paper were printed in total (here, "k" represents "1,000"). Also, for the comparative example, the copier having the conventional construction was used, and 120 k sheets of paper were printed in succession without performing the finely-divided toner particles collection process.

Figure 9:
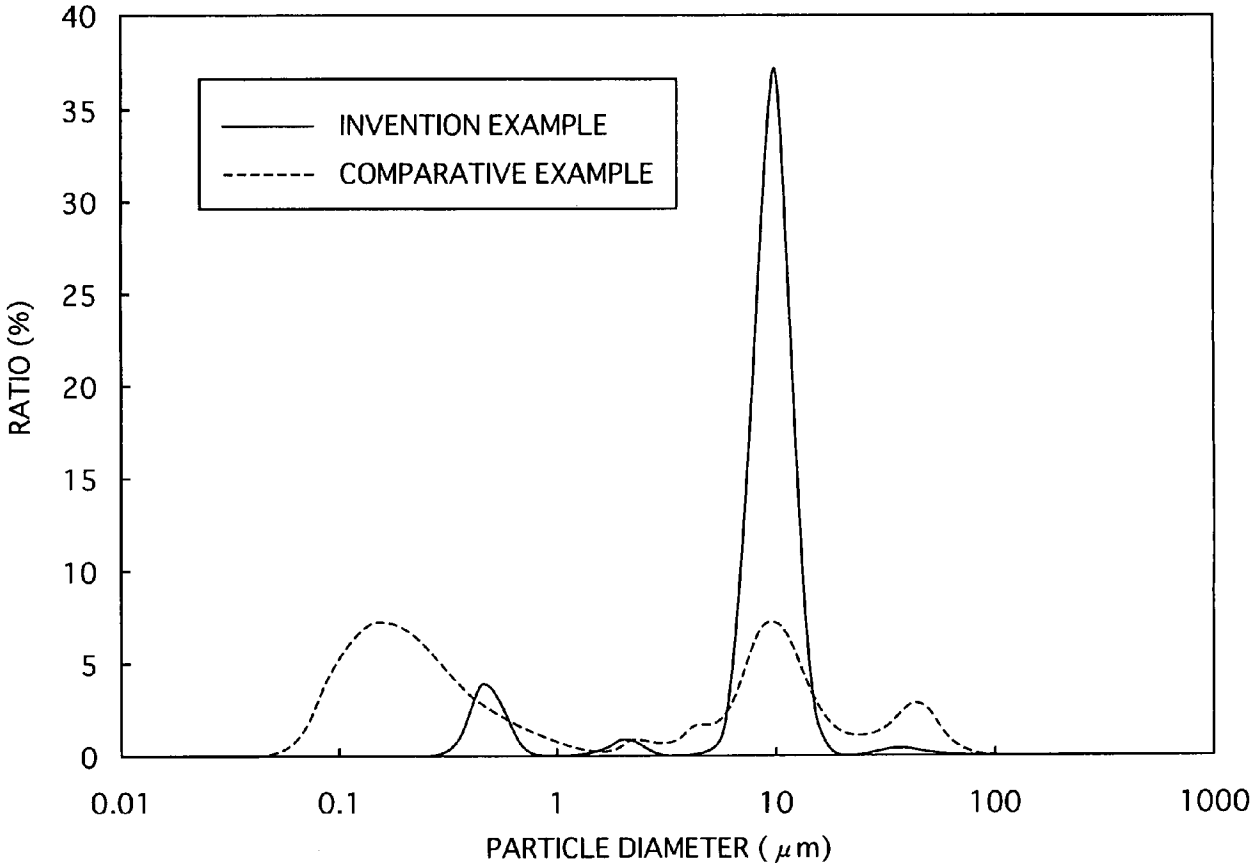
FIG. 9 shows the measurement results by the particle distribution measure.

The inventors of the present invention extracted the toner from the developing apparatus after 120 k sheets of paper were printed, dissolved the toner in a solvent, and measured the distribution of particles using a particle distribution measure based on the light scattering method. FIG. 9 shows the measurement results by the particle distribution measure, and the vertical axis of the graph represents the presence ratio (%), and the horizontal axis represents the particle diameter (μm). In FIG. 9, the solid line indicates the data for the invention example, and the dotted line indicates the data for the comparative example.

In FIG. 9, the regular toner particle diameter is approximately 10 μm, and particles having 1 μm or less diameter correspond to finely-divided toner particles. It is apparent from FIG. 9 that the comparative example has more finely-divided toner particles than particles of the regular particle diameter. In contrast, the invention example has a small ratio of finely-divided toner particles to particles of the regular particle diameter. From the measurement results, it is concluded that in terms of the invention example, the finely-divided toner particles have been collected from the developer.

Figure 10:
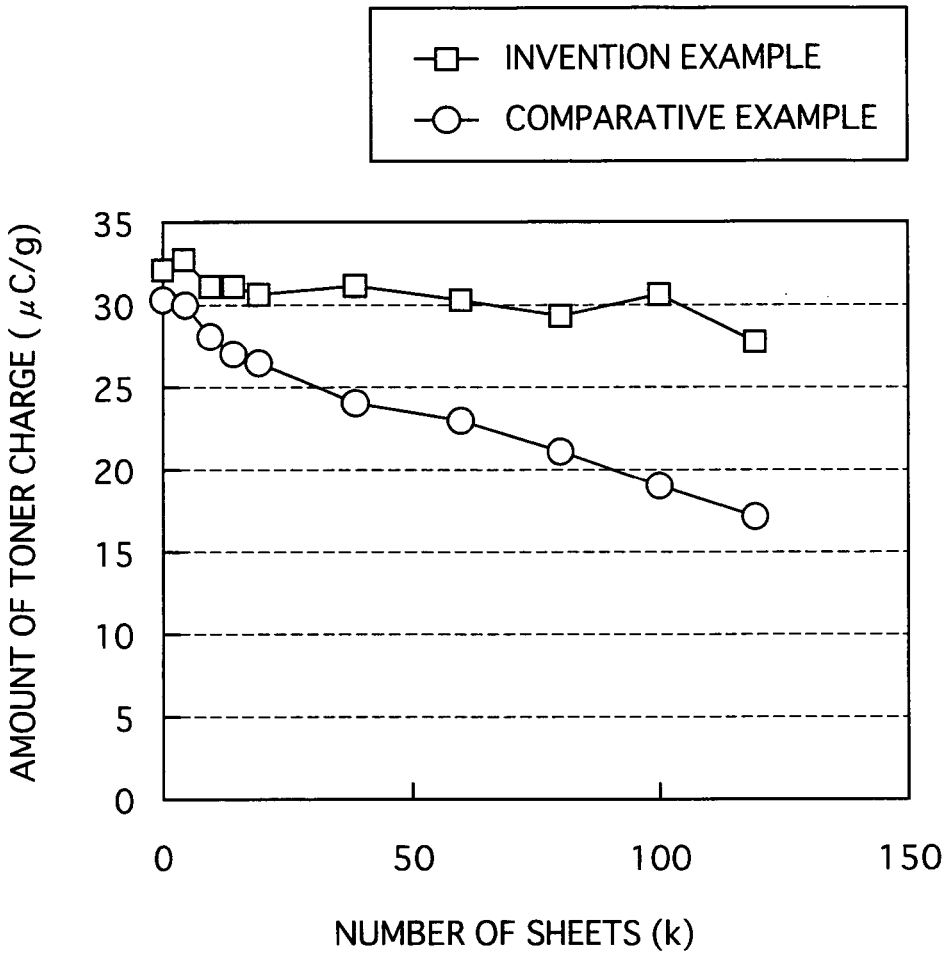
FIG. 10 is a graph showing changes in the amount of toner charge versus the number of printed sheets of paper.

The inventors of the present invention also measured the amount of toner charge while printing the 120 k sheets of paper. FIG. 10 is a graph showing changes in the amount of toner charge versus the number of printed sheets of paper. The vertical axis of the graph represents the amount of toner charge (μC/g), and the horizontal axis represents the number of printed sheets of paper (k).

It is understood from FIG. 10 that as the number of printed sheets increases, the amount of toner charge decreases in both the invention example and the comparative example. It is noted, however, that the rate at which the amount of toner charge decreases is extremely lower in the invention example than in the comparative example.

The reason for the above-stated fact is considered to be as follows. In the case of the invention example, finely-divided toner particles were collected from the carrier surface, which maintained the ability of the carrier to charge the toner with electricity. As a result of this, even as the number of printed sheets of paper was increased, the toner and the carrier were kept to be in good condition to generate electrical charge by the friction between them.

The combined results shown in FIGS. 9 and 10 make is possible to conclude that in the case of the invention example, the collection of finely-divided toner particles from the carrier surface restricts reduction in the amount of toner charge.

It is confirmed from the above-described characteristic test that the copier 1 of the present embodiment achieves a long life of the developer since the copier collects finely-divided toner particles from the carrier surface, which restricts reduction in the amount of toner charge.

<Modifications>

Up to now, the present invention has been described through an embodiment thereof. However, the present invention is not limited to the embodiment, but may be modified in various ways. The following, for example, shows such modifications.

(1) In the above-described embodiment, the toner is collected from the developer 3 by generating an electric field between the developing roller 241 and the buffer roller 242. However, the developing roller 241 and the buffer roller 242 may not necessarily be required in so far as the toner is collected from the developer 3 by generating an electric field. Also, in the above-described embodiment, the finely-divided toner particles are collected from the developer 3, from which the toner has been collected, by generating an electric field between the developing roller 241 and the photo receptor drum 21. However, the developing roller 241 and the photoreceptor drum 21 may not necessarily be required in so far as the finely-divided toner particles are collected from the developer 3 from which the toner has been collected.

Figure 11:
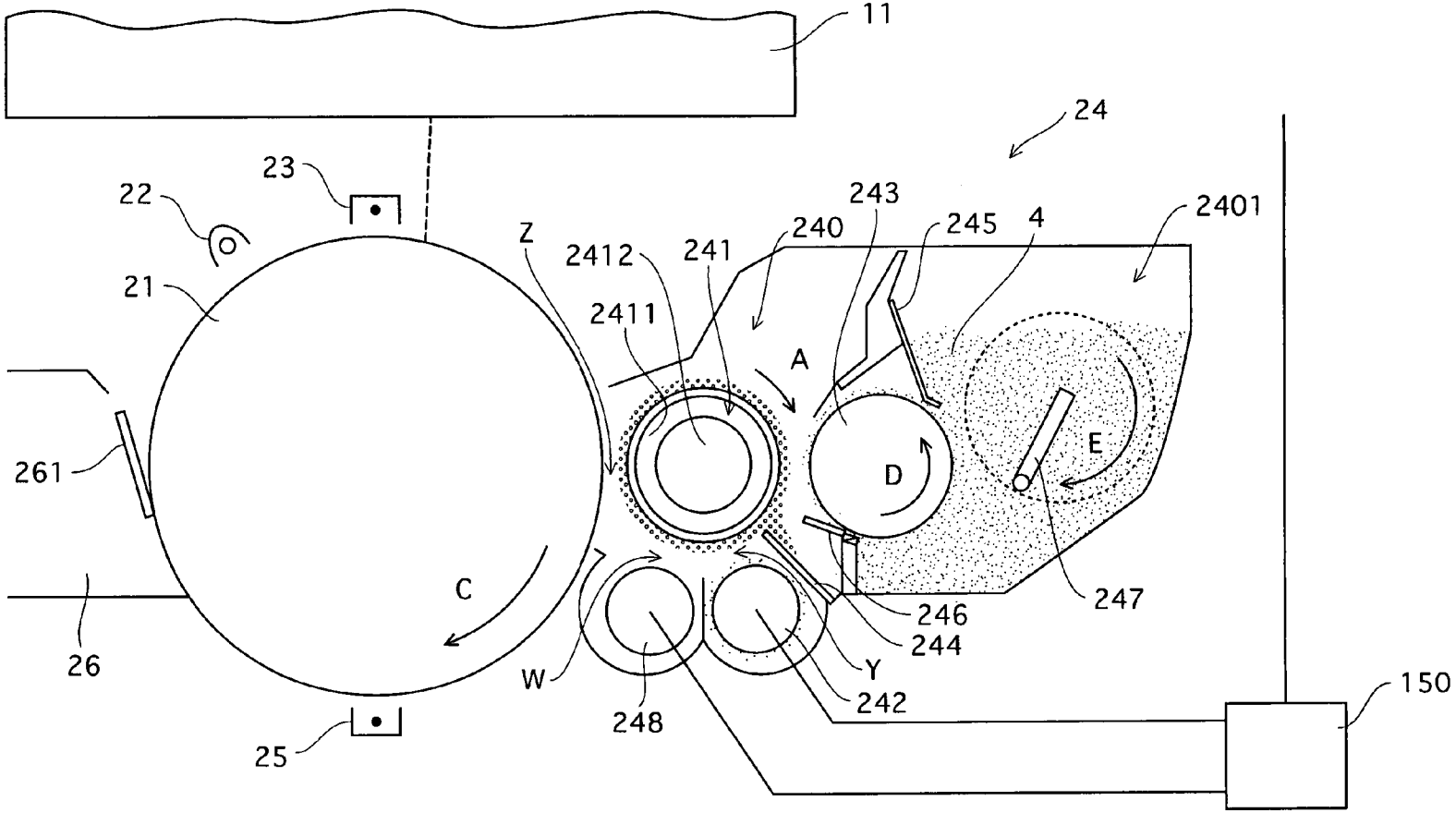
FIG. 11 shows a modification to the developing apparatus.

FIG. 11 shows a modification to the developing apparatus 24. As shown in FIG. 11, the modified developing apparatus 24 includes a finely-divided toner particles collection roller 248 for collecting finely-divided toner particles, at a position downstream of the buffer roller 242 in the route of conveyance of the developer, so as to face the developing roller 241 at the position.

Figure 12:
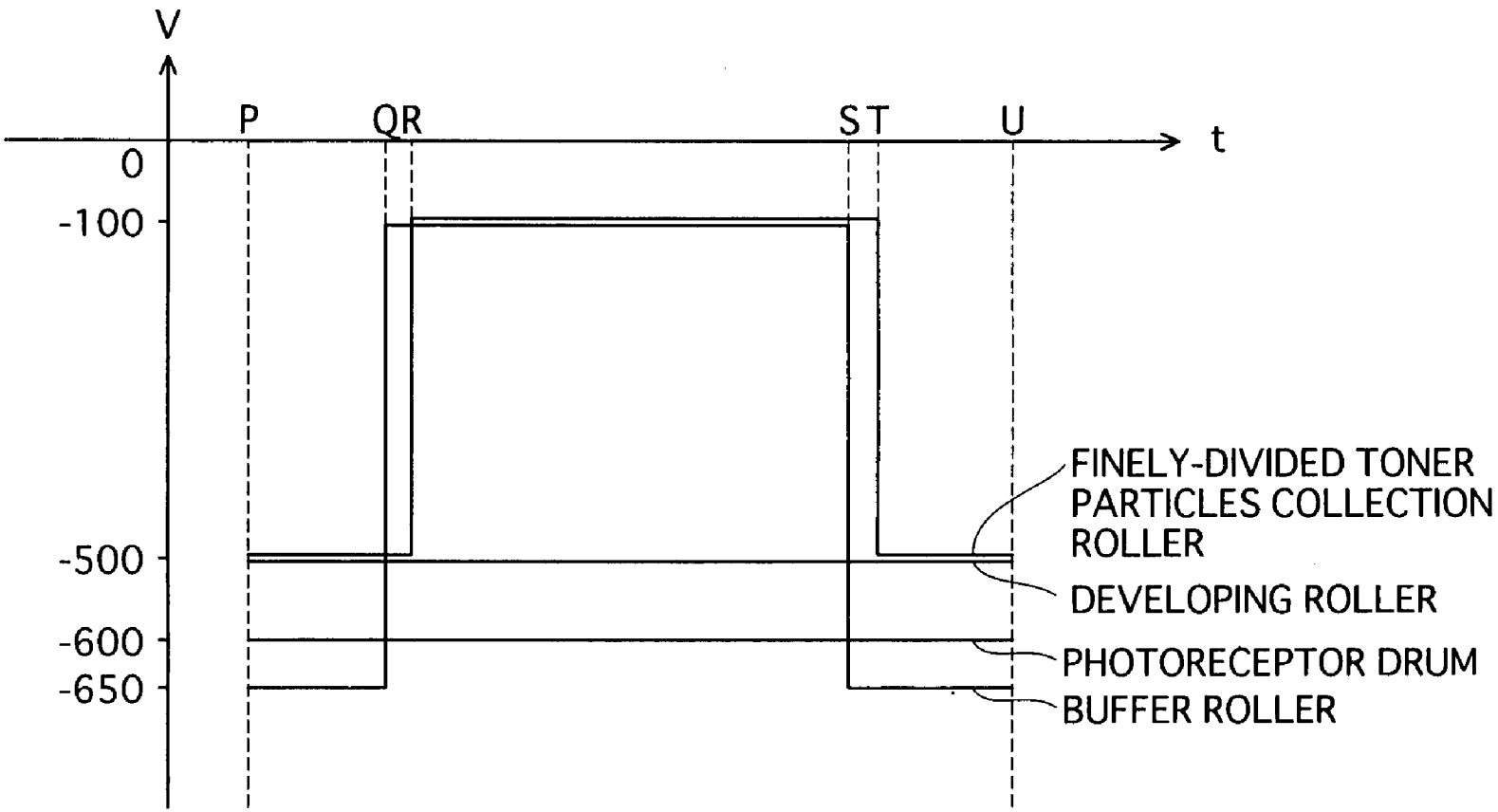
FIG. 12 shows changes with time in potentials of the developing roller 241, the buffer roller 242, the photoreceptor drum 21, and the finely-divided toner particles collection roller 248 in the finely-divided toner particles collection process of the modification.

With the construction of the modification, the sequence shown in FIG. 12 is executed instead of the sequence shown in FIG. 4. In the present modification, the sequence from time Q to time T is executed in the same manner as in the above-described embodiment. That is to say, as shown in FIG. 12, the developing roller 241 and the photoreceptor drum 21 maintain constant potentials −500V and −600V, respectively. At time Q, the potential of the buffer roller 242 is changed from −650V to −100V; at time R, the potential of the finely-divided toner particles collection roller 248 is changed from −500V to −100V; at time S, the potential of the buffer roller 242 is changed from −100V to −650V; and at time T, the potential of the finely-divided toner particles collection roller 248 is changed from −100V to −500V.

With such potential changes, in the time period between times Q and S, the toner is collected by the buffer roller 242 at the facing position Y where the developing roller 241 and the buffer roller 242 face each other, and in the time period between times R and T, the finely-divided toner particles are collected by the finely-divided toner particles collection roller 248 at the position where the developing roller 241 and the finely-divided toner particles collection roller 248 face each other. With this construction, the finely-divided toner particles are collected from the developer, which restricts the amount of toner charge, and achieves along life of the developer.

Alternatively, while the developer is conveyed on a wide and even-surfaced belt conveyor, a first electric field may be generated at position A so that the toner can be collected from the developer, and a second electric field may be generated at position B, which is downstream of position A in the route of conveyance of the developer, so that the finely-divided toner particles can be collected from the carrier.

(2) In the above-described embodiment, strontium titanate is used as an external additive for the plus charge. However, the external additive for the plus charge maybe selected from a group consisting of: silicon oxide, aluminum oxide, titanium oxide, magnesium oxide, barium titanate, magnesium titanate, calcium titanate, and calcium zirconate. It is considered that when used as external additives while charged with plus electricity, such compounds generate electric actions that make the finely-divided toner particles easy to remove from the surface of the carrier.

(3) In the above-described embodiment, the toner is charged with minus electricity, and the external additives charged with plus electricity are used. However, the toner may be charged with plus electricity, and the external additives charged with minus electricity may be used. In this case, it is required to reverse the direction of the electric field for collecting the toner and the finely-divided toner particles. This makes it possible to collect the finely-divided toner particles based on the same above-described principle.

(4) In the above-described embodiment, in the sequence shown in FIG. 4, the developing roller 241 has rotated twice during the time period from time Q, at which the finely-divided toner particles start to be collected, to time S. However, not limited to this, an appropriate time period may be determined as the time required to perform the finely-divided toner particles collection process. Also, the sequences shown in FIG. 4 and FIG. 12 relate to the case where the direct currents are used. However, alternating currents having waveforms similar to those shown in FIG. 4 and FIG. 12 may be superimposed on the waveforms of FIG. 4 and FIG. 12, respectively.

The present invention is broadly applicable to an image forming apparatus and a developing apparatus using a two-component developer containing a toner and a carrier. Also, the present invention achieves a long life of the developer. The present invention therefore has great utility values in industry.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus for forming an image by developing a latent image formed on an image carrier, using a developer including a toner and a carrier, the image forming apparatus comprising:

a developer conveying member that conveys the developer;

a first collecting unit that collects, by generating a first electric field, the toner from the developer at a first position that is set halfway through a route of conveyance of the developer by the developer conveying member; and a second collecting unit that collects, by generating a second electric field, finely-divided toner particles from the developer at a second position that is downstream of the first position in the route of conveyance of the developer.

2. The image forming apparatus of claim 1, wherein the developer includes an external additive having a polarity that is opposite of a polarity of the toner.

3. The image forming apparatus of claim 1 further comprising:

a supply unit that supplies the developer with toner, wherein a position at which the supply unit supplies the toner is upstream of the first position in the route of conveyance of the developer.

4. The image forming apparatus of claim 1 further comprising:

a tone returning unit that returns the toner collected by the first collecting unit to the developer that is being conveyed, wherein the second collecting unit stops collecting finely-divided toner particles before the developer including the toner returned thereto by the toner returning unit conveyed to the second position.

5. The image forming apparatus of claim 1 further comprising:

a discarding unit that discards the finely-divided toner particles collected by the second collecting unit.

6. The image forming apparatus of claim 1, wherein collections of toner by the first collecting unit and the second collecting unit are performed while an ordinary image forming process is not performed.

7. The image forming apparatus of claim 1, wherein the first collecting unit includes:

a first rotatable member that is disposed to face the developer conveying member at the first position; and a first electric field generating unit that generates the first electric field between the developer conveying member and the first rotatable member, and the second collecting unit includes:

a second rotatable member that is disposed to face the developer conveying member at the second position; and a second electric field generating unit that generates the second electric field between the developer conveying member and the second rotatable member.

8. The image forming apparatus of claim 7, wherein the image carrier is used as the second rotatable member.

9. The image forming apparatus of claim 1, wherein the first electric field is substantially equal to the second electric field in strength.

10. A developing apparatus for developing a latent image formed on an image carrier, using a developer including a toner and a carrier, the developing apparatus comprising:

a developer conveying member that conveys the developer;

a first collecting unit that collects, by generating a first electric field, the toner from the developer at a first position that is set halfway through a route of conveyance of the developer by the developer conveying member; and a second collecting unit that collects, by generating a second electric field, finely-divided toner particles from the developer at a second position that is downstream of the first position in the route of conveyance of the developer.

11. A developing apparatus for developing a latent image formed on an image carrier, using a developer including a toner and a carrier, the developing apparatus comprising:

a developer conveying member that conveys the developer; and a first collecting unit that collects, by generating a first electric field, the toner from the developer at a first position that is set halfway through a route of conveyance of the developer by the developer conveying member, wherein the image carrier is disposed to face the developer conveying member at a second position that is downstream of the first position in the route of conveyance of the developer, and at the second position, a second electric field is generated to move finely-divided toner particles from the developer after the toner is collected therefrom by the first collecting unit, to the image carrier.

12. The developing apparatus of claim 10, wherein the developer includes an external additive having a polarity that is opposite of a polarity of the toner.

13. The developing apparatus of claim 11, wherein the developer includes an external additive having a polarity that is opposite of a polarity of the toner.

14. The developing apparatus of claim 10 further comprising:

a toner returning unit that, returns the toner collected by the first collecting unit to the developer that is being conveyed, wherein the second collecting unit stops collecting finely-divided toner particles before the developer including the toner returned thereto by the toner returning unit is conveyed to the second position.

15. The developing apparatus of claim 11 further comprising:

a toner returning unit that returns the toner collected by the first collecting unit to the developer that is being conveyed, wherein the second electric field is stopped before the developer including the toner returned thereto by the toner returning unit is conveyed to the second position.

16. The developing apparatus of claim 10 further comprising a supply unit that supplies the developer with toner, wherein a position at which the supply unit supplies the toner is upstream of the first position in the route of conveyance of the developer.

17. The developing apparatus of claim 11 further comprising:

a supply unit that supplies the developer with toner, wherein a position at which the supply unit supplies the toner is upstream of the first position in the route of conveyance of the developer.

18. The developing apparatus of claim 10, wherein the first electric field is substantially equal to the second electric field in strength.

19. The developing apparatus of claim 11 wherein the first electric field is substantially equal to the second electric field in strength.

20. A finely-divided toner particles collecting method for collecting finely-divided toner particles that are generated by cuts and cracks of toner particles, in an image forming apparatus for forming an image by developing a latent image formed on an image carrier, using a developer including a toner and a carrier, the finely-divided toner particles collecting method comprising:

a first collecting step of collecting the toner from the developer by a first electric field; and a second collecting step of collecting the finely-divided toner particles from the developer by a second electric field, after the toner is collected therefrom in the first collecting step.

21. The finely-divided toner particles collecting method of claim 17, wherein in the first collecting step, the toner is collected into a first collecting member, and in the second collecting step, the finely-divided toner particles are collected into a second collecting member that is different from the first collecting member.

22. The finely-divided toner particles collecting method of claim 17, wherein the developer includes an external additive having a polarity that is opposite of a polarity of the toner.

23. The finely-divided toner particles collecting method of claim 17, wherein the first electric field is substantially equal to the second electric field in strength.

24. The finely-divided toner particles collecting method of claim 17, wherein:

collections of toner in the first collecting, step and the second collecting step are performed while an ordinary image forming process is not performed.

* * * * *

UNITED STATES PATENT AND TRADEMARK OFFICE

CERTIFICATE OF CORRECTION

PATENT NO. : 7,263,320 B2
APPLICATION NO. : 11/305499
DATED : August 28, 2007
INVENTOR(S) : Junya Hirayama et al.

It is certified that error appears in the above-identified patent and that said Letters Patent is hereby corrected as shown below:

In the Claims

Column 18, in claim 14, line 61, immediately after "returning unit that" delete "," (comma).

Column 20, in claim 24, line 28, immediately after "in the first collecting" delete "," (comma).

Signed and Sealed this

Twenty-fifth Day of December, 2007

JON W. DUDAS
*Director of the United States Patent and Trademark Office*